United States Patent [19]

La Pointe

[11] 4,111,246

[45] Sep. 5, 1978

[54] LOG-SPLITTING ACCESSORY FOR BACK HOE POWER EQUIPMENT

[76] Inventor: Roland La Pointe, Rte. 2, Winthrop, Me. 04364

[21] Appl. No.: 756,951

[22] Filed: Jan. 5, 1977

[51] Int. Cl.[2] ..... B27L 7/00

[52] U.S. Cl. ..... 144/193 A; 144/193 R

[58] Field of Search ..... 144/2 N, 193 R, 193 A, 144/309 R, 323; 254/104

[56] References Cited

U.S. PATENT DOCUMENTS

| | | | |
|---|---|---|---|
| 3,280,864 | 10/1966 | Spanenberg | 144/193 A |
| 3,779,295 | 12/1973 | Balsbaugh | 144/193 A |
| 3,780,779 | 12/1973 | Guy | 144/2 N X |
| 3,938,567 | 2/1976 | Dircksen et al. | 144/193 E |
| 4,019,549 | 4/1977 | Williams | 144/193 A |

*Primary Examiner*—Othell M. Simpson
*Assistant Examiner*—W. D. Bray
*Attorney, Agent, or Firm*—William Nitkin

[57] ABSTRACT

Power log-splitting apparatus utilized as accessory to back hoe-equipped power equipment comprising a base, an upright member affixed to the base with means for affixing the upright member to the stick member of the back hoe with a wedge member affixed to the piston of the back hoe. Rail means are provided within which said wedge member is guided into a log to be split, and a strong bar affixed to the back hoe's stick member is adapted to prevent tilting of the base while the log splitter is in use.

3 Claims, 12 Drawing Figures

Wedge

Control Rod

Strong Bar

LOG-SPLITTING ACCESSORY FOR BACK HOE POWER EQUIPMENT

BACKGROUND OF THE INVENTION

The device of this invention relates to the splitting of logs and more particularly to power-driven log splitters.

Power-driven log-splitting devices have long been in use. They fall in various categories, some of which may be characterized by devices such as described in U.S. Pat. No. 3,285,304 to O. C. Fuller which incorporates an hydraulic piston mounted on a framework adapted to force a wedge into the log to be split. U.S. Pat. No. 3,280,864 by O. C. Spanenberg discloses a similar device having an hydraulic piston forcing the log against a wedge thereby causing its splitting. U.S. Pat. No. 3,779,295 by Balsbaugh discloses a device utilizing an hydraulic piston forcing a wedge into the log wherein the operative mechanism is tiltable on a frame so that one may not necessarily have to lift the log up into the mechanism, but can merely stand the log on the base for splitting. There are several devices such as characterized in U.S. Pat. Nos. 3,319,675 to M. J. Bles, Sr.; 3,356,115 to H. J. Cole; 3,760,854 to Worthington; and 3,938,567 to Dickerson which are accessories to tractor units containing various embodiments of mechanisms for the splitting of logs and usually fit as accessories toward the rear of the tractor. A device which fits at the front of the tractor in lieu of a front end loader bucket is disclosed in U.S. Pat. No. 3,780,779 to Guy. Disclosed is an hydraulic piston forcing the log into a wedge at the base of an arm member.

SUMMARY

It is an object of this invention to disclose a power log splitter which can be utilized as an accessory to power equipment having a back hoe arm. The apparatus of this invention contains no hydraulic parts in its construction and can be attached directly to a back hoe and functions utilizing the back hoe's boom and stick in their regular mode of operation including the utilization of the hydraulics of the back hoe's boom and stick. The device of this invention is affixed to the stick member at the end of the boom of the back hoe and the wedge is interconnected to the hydraulic piston located above the boom's stick. This wedge moves downward according to the movement of the piston which is actuated hydraulically through the rubber hydraulic lines running to control members on the back hoe's body. As the wedge moves downward, its movement is channeled within a frame. Logs to be split are placed on the base of the frame in vertical alignment with the wedge which is forced downward into the log. The apparatus of this invention functions with superior power in splitting logs and can be economically and easily manufactured to meet the needs of additional split wood for burning in times of other fuel's shortage or high cost.

DESCRIPTION OF THE PREFERRED EMBODIMENT

Figure 1:
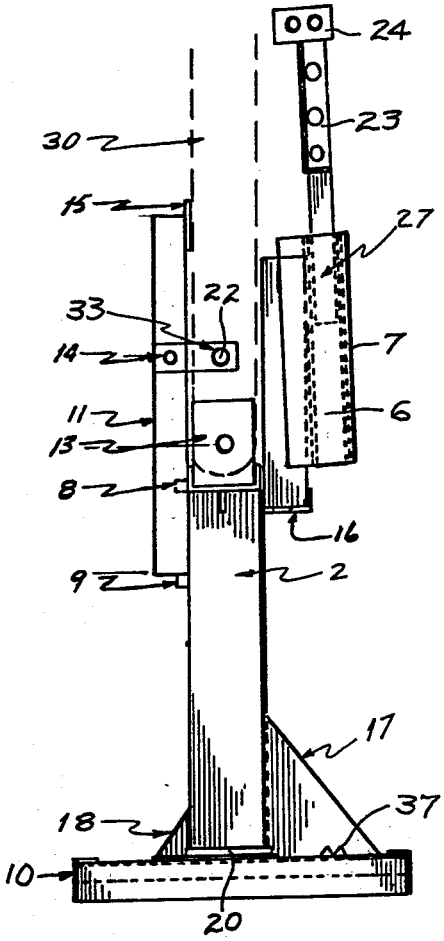
FIG. 1 illustrates a side view of the device of this invention.
Figure 5:
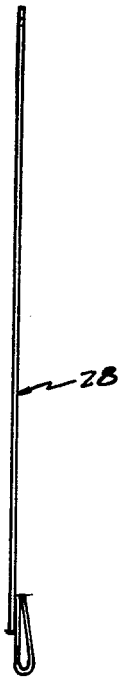
FIG. 5 illustrates the control rod member.
Figure 6A:
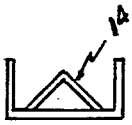
FIGS. 6a, b, and c illustrate bottom, front and side views of the strong bar member.
Figure 6B:
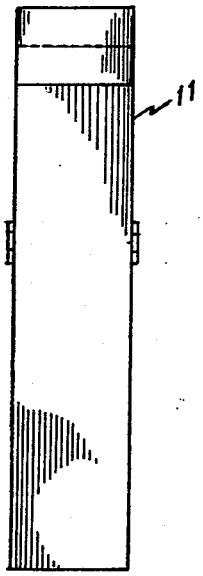
Figure 6C:
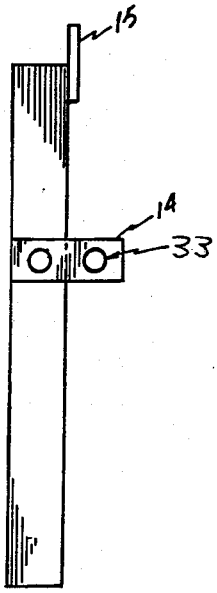
Figures 7, 8:
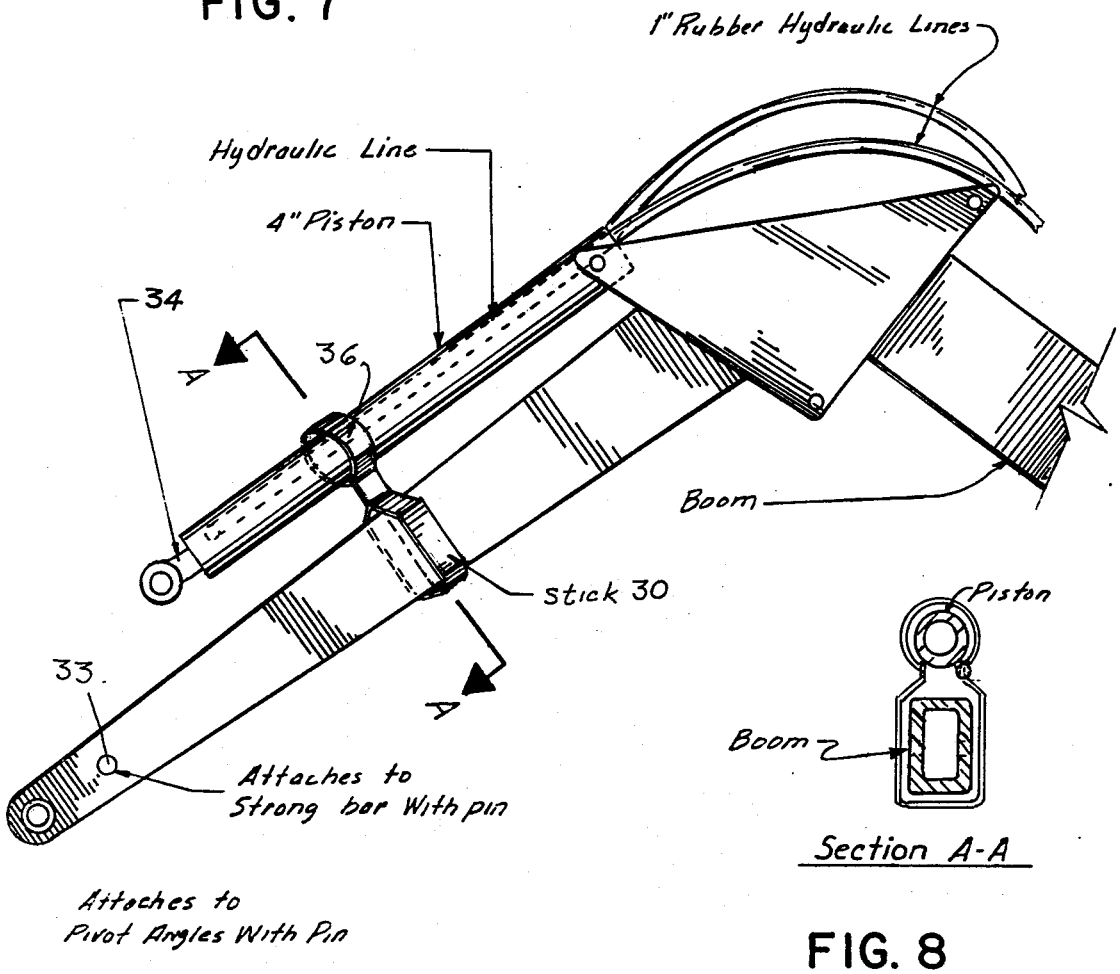
FIG. 7 illustrates back hoe boom and stick members.
FIG. 8 illustrates a sectional view through A—A of FIG. 7.
Figure 9:
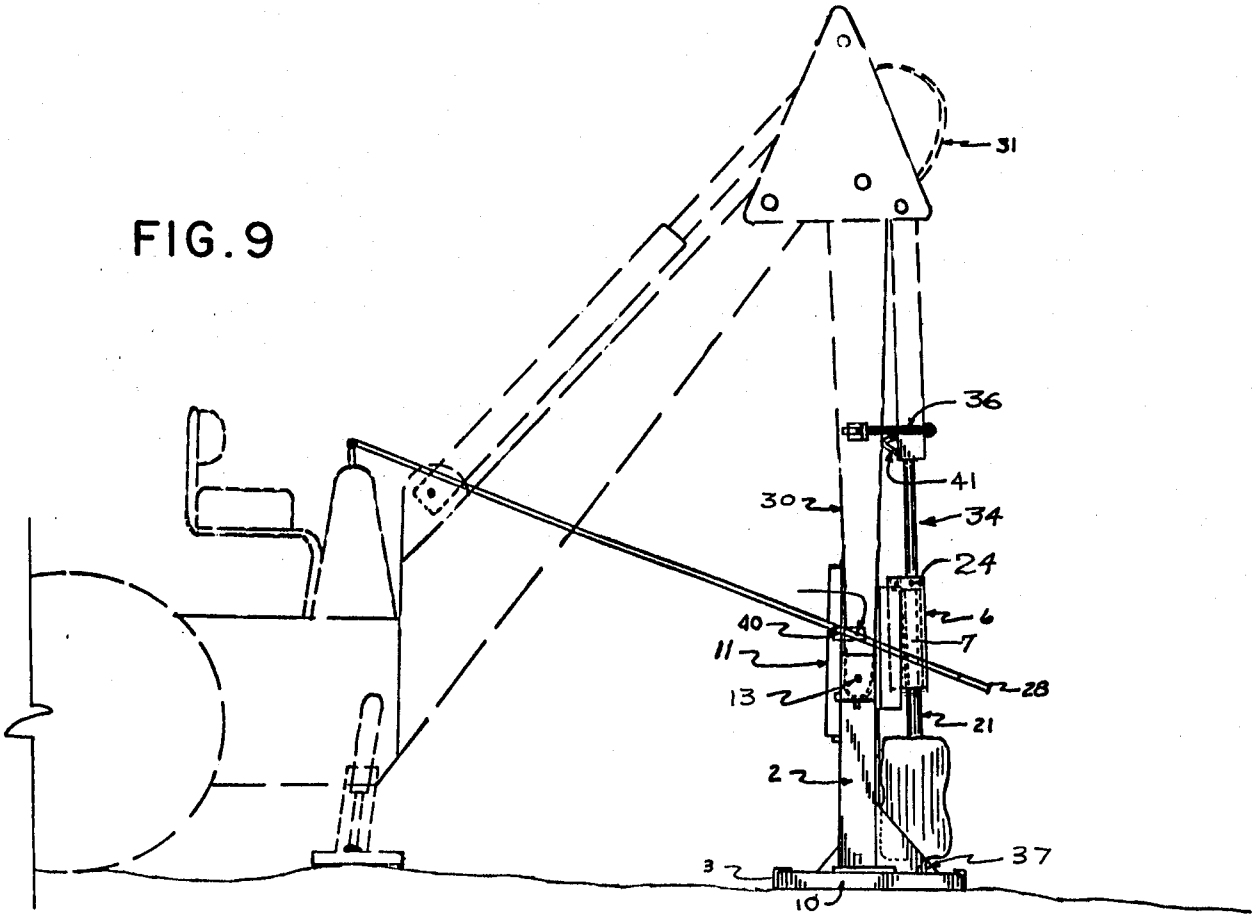
FIG. 9 illustrates a side view of invention in use.

FIG. 1 illustrates a side view of the device of this invention showing its connection to the boom's stick 30 in outline form. The device of this invention can be completely fabricated of welded steel parts or equivalent strong metal. Affixed to the stick of the boom by pivot 13 at its end is upright member 2. Base support 10 rests on the ground. Upright member 2 is affixed to base member 10 at shoe members 20 and has gusset support members 17 and 18. Since the back hoe's stick 30 extends angularly, the hydraulic piston movement along this arm would tend to push at an angle to the vertical. Therefore to keep the upright member 2 vertical, a strong bar 11 is utilized by affixation to the boom's stick 30 by pin 22 through a hole 33 in the boom's stick and through strong bar hanger 14 which is affixed to strong bar 11. The strong bar is further braced along upright member 2 by bar 8 and bearing bar 9. Strong bar 11 prevents the tilting of upright member 2 and base 10 angularly away from the vertical while the apparatus is in use. The strong bar further has strong bar bumper 15 which rests against the back hoe's boom's stick 30. Wedge 27 is affixed at its base to wedge rail 23 which is adapted to slide within rails 7 downward when the hydraulic piston is activated into the logs which are manually positioned vertically on base 10. Piston rod 34 is affixed to wedge hanger 24 by a pin. It is envisioned when using the device of this invention that control rod 28 illustrated in FIG. 5 can be attached to the hydraulic controlling lever on the control panel of the back hoe and will extend outward to the location of the apparatus of the invention so that when a log is positioned on base 10, the apparatus can be activated while the operator is standing next to the unit by his pulling on control rod 28. Also used in conjunction with the device of this invention is collar member 36 composed of steel or equivalent strong metal which is affixed to the boom's stick and to the hydraulic piston so that when in operation these two members do not move apart from one another. Collar member 36 is also seen in FIG. 8. A collar member brace 41 is seen in FIG. 9.

Figure 3:
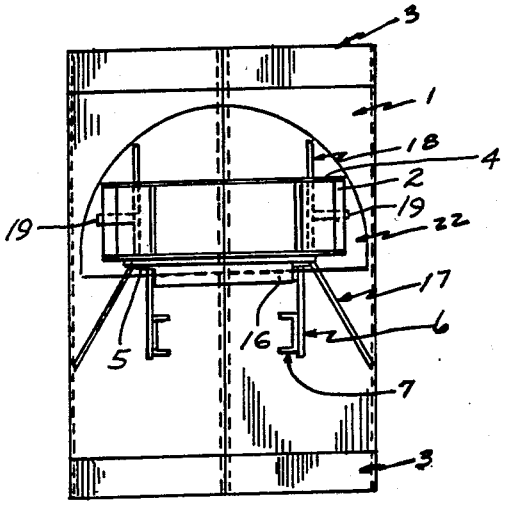
FIG. 3 illustrates a top view of the device of this invention.
Figure 2:
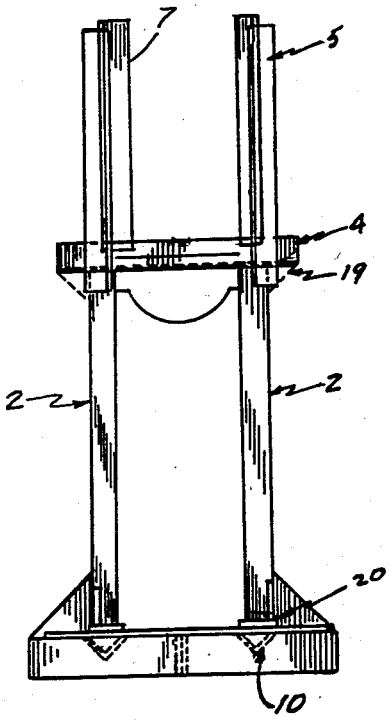
FIG. 2 illustrates a front view of the device of this invention.
Figure 4A:
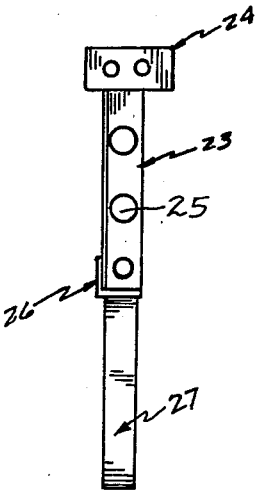
FIGS. 4a and 4b illustrate a side and front views of the wedge member.
Figure 4B:
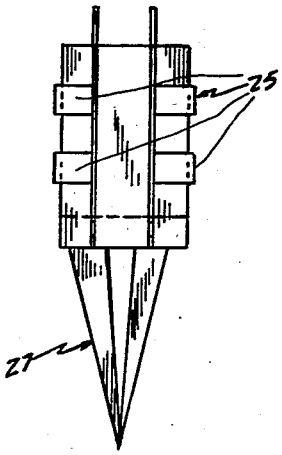

FIG. 2 illustrates a front view of the apparatus of this invention showing upright member 2 which is affixed at its top to cross support member 4 with associated gussets 19 fixed at each end for strength. Rail support spreader 16 is affixed to the front of upright member 2 to which rail supports 5 are affixed. Seen attached to rail supports 5 in FIG. 3 are two rail plates 6 at each side, on each of which are mounted rails 7 in which pin guides 25 of wedge 27 illustrated in FIG. 4 are slideably engaged. It should be noted that rails 7 and their assembly components are affixed at a slight rearward angle to accommodate the slight angular movement of the piston. Affixed to base 10 can be log support member 37 seen in FIG. 3 and in outline in FIG. 1 on which the log can be stood on end in order to tip the log slightly rearward to facilitate entry of the wedge vertically directly into the log and to prevent it from becoming dislodged while the wedge moves downward.

It should be noted that the device of this invention can be used vertically or horizontally if desired as in some situations horizontal use may make it less necessary to move the back hoe frequently when working at large wood piles. A further advantage of the device of this invention becomes apparent should the wedge become lodged in a piece of wood. In such a situation the operator could actuate the wedge upward and the wood would be arrested and dislodged when it makes contact with rail support spreader 16.

Although the present invention has been described with reference to particular embodiments, it will be apparent to those skilled in the art that variations and modifications can be substituted therefor without departing from the principles and spirit of the invention.

I claim:

1. A log-splitting apparatus that is an accessory to back hoe equipped power equipment of the type having a boom member, a stick member pivotally attached to said boom member and a piston member mounted parallel to said stick member, said apparatus comprising:

a base;

an upright member affixed to said base;

connecting means for affixing said upright member to the stick member of said back hoe;

a wedge member;

means to affix said wedge member to said piston member;

rail means affixed to said upright member for guiding said wedge member; and an elongated stabilizing bar affixed to said back hoe's stick member adapted to contact said upright member in overlapping relation with said connecting means of said upright member and stick.

2. An apparatus as recited in claim 1 further including collar means for affixing said back hoe's stick member to said back hoe's piston so that they will not move apart during operation.

3. An apparatus as recited in claim 1 further including a support member mounted on said base to support logs at the proper angle for splitting.

* * * * *